US006880569B2

(12) United States Patent
Kato

(10) Patent No.: US 6,880,569 B2
(45) Date of Patent: Apr. 19, 2005

(54) FUEL SUPPLYING APPARATUS

(75) Inventor: Hideki Kato, Toyohashi (JP)

(73) Assignee: Denso Corporation, Kariya (JP)

( * ) Notice: Subject to any disclaimer, the term of this patent is extended or adjusted under 35 U.S.C. 154(b) by 213 days.

(21) Appl. No.: 10/277,934

(22) Filed: Oct. 23, 2002

(65) Prior Publication Data

US 2003/0079783 A1 May 1, 2003

(30) Foreign Application Priority Data

Oct. 30, 2001 (JP) ..... 2001-332251

(51) Int. Cl.[7] ..... F02M 37/14

(52) U.S. Cl. ..... 137/565.22; 137/576; 123/514; 417/80

(58) Field of Search ..... 137/565.22, 576; 123/509, 514; 417/76, 79, 80, 88, 89

(56) References Cited

U.S. PATENT DOCUMENTS 5,080,077 A * 1/1992 Sawert et al. ..... 123/509
5,330,475 A 7/1994 Woodward et al.
5,341,842 A * 8/1994 Chih et al. ..... 123/514
5,452,701 A * 9/1995 Tuckey ..... 123/509
5,769,061 A * 6/1998 Nagata et al. ..... 123/509
5,881,698 A * 3/1999 Tuckey et al. ..... 123/509
5,960,775 A * 10/1999 Tuckey ..... 123/509
6,098,600 A 8/2000 Umetsu et al.
6,155,793 A 12/2000 Tuckey et al.
6,260,543 B1 * 7/2001 Chih ..... 123/509
6,269,800 B1 * 8/2001 Fischerkeller et al. ..... 123/514
6,453,884 B2 * 9/2002 Ushigome ..... 123/509
6,478,014 B1 * 11/2002 Kohlhaas ..... 123/509
6,488,476 B2 * 12/2002 Eck ..... 417/76
6,513,503 B2 * 2/2003 Iwamoto et al. ..... 123/509
6,520,161 B2 * 2/2003 Hazama ..... 123/509

FOREIGN PATENT DOCUMENTS

JP 3-156161 7/1991

* cited by examiner

*Primary Examiner*—John Rivell
(74) *Attorney, Agent, or Firm*—Nixon & Vanderhye P.C.

(57) ABSTRACT

A fuel supplying apparatus for use with a main fuel tank and an engine includes a fuel discharge pipe for supplying fuel to the engine, a sub-tank disposed in the main fuel tank, a fuel pump for pressurizing fuel and a jet pump. The jet pump includes a throat and a nozzle projecting into the throat from the bottom wall of the sub-tank. The throat has a fuel inlet opening disposed outside the sub-tank and a fuel discharge opening disposed in the sub-tank. When pressured fuel is injected into the inlet opening of the throat, the fuel in the main tank is sucked to the sub-tank.

12 Claims, 4 Drawing Sheets

FUEL SUPPLYING APPARATUS

CROSS REFERENCE TO RELATED APPLICATION

The present application is based on and claims priority from Japanese Patent Application 2001-332251, filed Oct. 30, 2001, the contents of which are incorporated herein by reference.

BACKGROUND OF THE INVENTION

1. Field of the Invention

The present invention relates to a fuel supplying apparatus for a vehicle that includes a fuel pump, a sub-tank and a jet pump for pumping fuel from a main fuel tank into a sub-tank.

2. Description of the Related Art

A fuel supplying apparatus that includes a fuel pump disposed in a sub-tank to maintain fuel level in the sub-tank even if fuel in a main tank is running out, as disclosed in U.S. Pat. No. 6,155,793. The fuel supplying apparatus disclosed in U.S. Pat. No. 6,155,793 includes a fuel pump and a jet pump. In such a fuel supplying apparatus, the fuel pump supplies a portion of pumped up fuel to the jet pump to make the jet pump suck fuel from the main fuel tank to the sub-tank by a vacuum that is generated when the jet pump injects fuel. Accordingly, the jet pump supplies fuel into the sub-tank, so that the fuel level in the sub-tank becomes higher than the fuel level in the main tank. Therefore, the fuel pump can pump up a sufficient amount of the fuel from the sub-tank even if the fuel in the main tank runs short.

However, because the whole of the jet pump of the fuel supplying apparatus disclosed in U.S. Pat. No. 6,155,793 is disposed in the sub-tank, the sub-tank necessitates many parts and assembling steps.

SUMMARY OF THE INVENTION

Therefore, the present invention has been made in view of the above problems.

A main object of the invention is to provide a fuel supplying apparatus that does not necessitate many parts or assembling steps.

According to a feature of the invention, the fuel supplying apparatus includes a fuel discharge pipe for supplying fuel to the engine, a sub-tank disposed in the main fuel tank, a fuel pump, and a jet pump including a throat and a nozzle projecting into the throat from the bottom wall of the sub-tank. The throat has a fuel inlet opening disposed outside the sub-tank and a fuel discharge opening disposed inside the sub-tank. Therefore, it is not necessary to provide a complicated fuel passage for the jet pump, and, accordingly, a simple sub-tank can be formed.

The fuel pump of the above featured fuel supplying apparatus may have a vent for venting gases generated inside said fuel pump. This vent decreases vapor or gases in the fuel supplied to an engine. The fuel pump may include a resinous case with the nozzle integrated therewith.

Preferably, the sub-tank and the throat may be made of resinous material and integrated with each other. The nozzle may comprise a separate nozzle member fixed to the sub-tank. The sub-tank may have a cushion member between the bottom of the sub-tank and the bottom of the main tank to moderate vibration transmitted from the main tank. The jet pump may have a check valve for preventing fuel in the sub-tank to the main tank.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
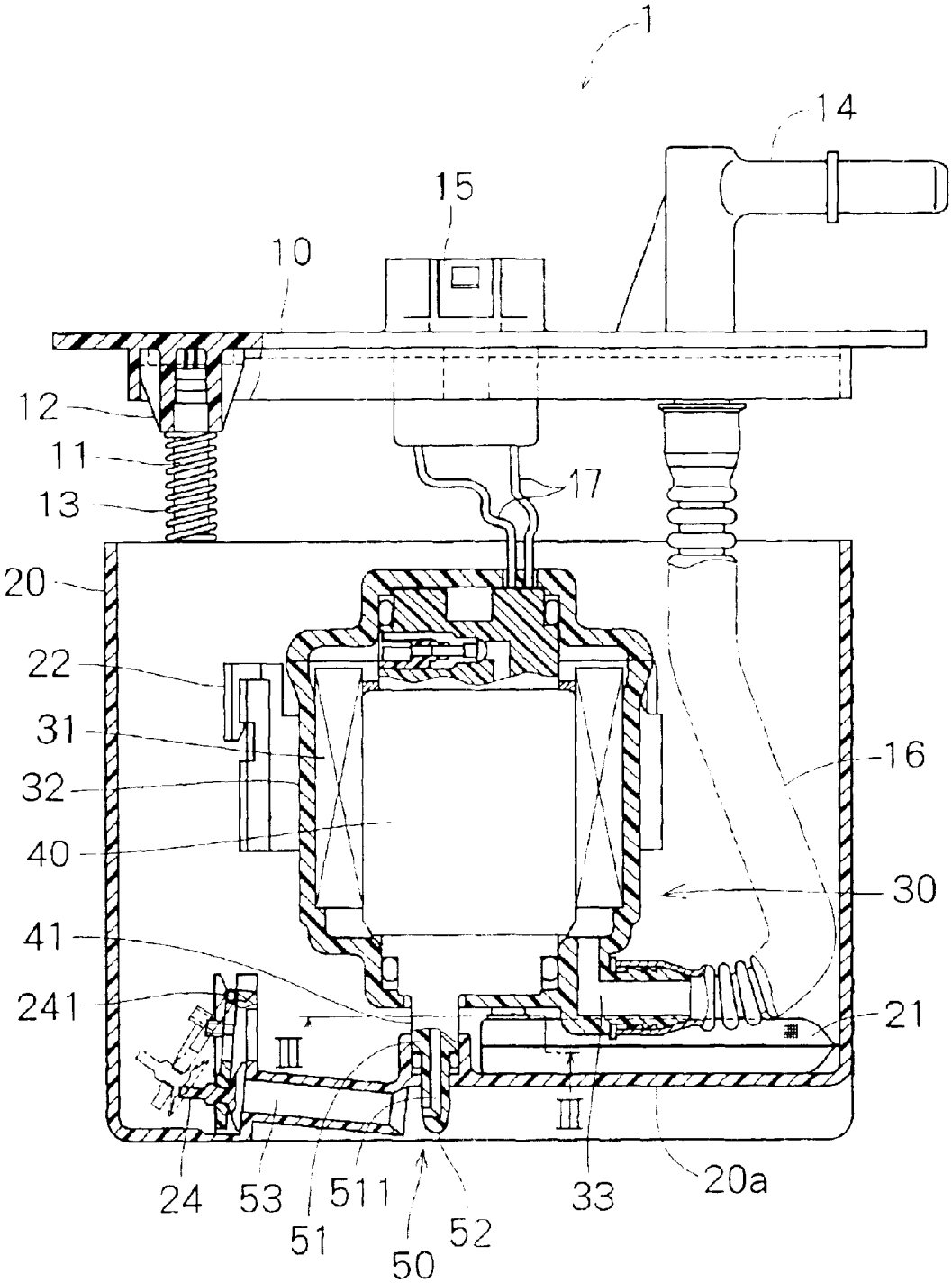
FIG. 1 is a schematic cross-sectional diagram illustrating a fuel supplying apparatus according to a preferred embodiment of the invention.

A fuel supplying apparatus according to a preferred embodiment of the invention is described with reference to FIGS. 1 and 2.

The fuel supplying apparatus 1 is comprised of a resinous flange 10 fixed by a metal columnar member 11 to an upper wall of a main fuel tank, a resinous sub-tank 20, a suction filter 21, a pump unit 30, which are accommodated in the main fuel tank together with other parts. An end of the columnar member 11 is inserted into a cylindrical portion 12 of the flange 10, and the other end of the columnar member 11 is fixed to a cover (not shown) of the sub-tank 20. The upper portion of the sub-tank 20 is generally open. The sub-tank 20 can move in the longitudinal direction of the columnar member 11. A compression coil spring 13 is disposed around the columnar member 11 to urge the bottom of the sub-tank 20 against the bottom of the main fuel tank when the sub-tank 20 is mounted.

A discharge pipe 14 and an electric connector 15 are formed in the flange 10. The discharge pipe 14 and the electric connector 15 can be either molded together with the flange 10 or separately formed. The discharge pipe 14 discharges fuel pumped by the pump unit 30 outside the main fuel tank. The discharge pipe 14 is connected to a fuel pipe 33 of the pump unit 30 by a flexible tubular bellows 16. The electric connector 15 receives electric power for the pump unit 30 and sends a fuel level signal to the outside. The electric connector 15 and the pump unit 30 are connected by lead wires 17.

The pump unit 30 is comprised of a fuel filter 31, a pump unit case 32, a support member 22, a fuel pump 40 and a jet pump 50. The fuel filter 31 and the fuel pump 40 are housed in the pump unit case 30. The pump unit 30 is fixed to the sub-tank 20 by the support member 22. The fuel pump 40 pressures the fuel supplied into the sub-tank 20 through the suction filter 21 and discharges the fuel to the outside through the tubular bellows 16 and the discharge pipe 14. The fuel pump 40 has a pump case 41. The fuel pipe 33 is formed in the pump unit case 32.

Figure 3:
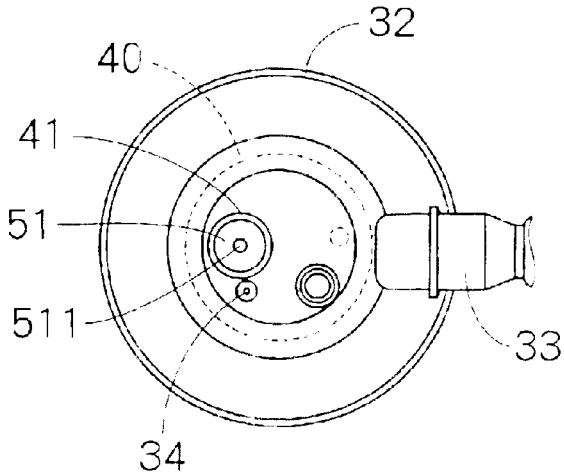
FIG. 3 is an enlarged plan view of a portion of the fuel supplying apparatus shown in FIG. 1 cut along line III—III.

The suction filter 21 filters comparatively larger foreign particles from the fuel discharged from the fuel pump 40, and the fuel filter 31 filters comparatively smaller foreign particles included in the fuel. The unit case 32 has a vent 34 for discharging gases generated by the fuel pump 40 into the sub-tank 20, as shown in FIG. 3.

The jet pump 50 is comprised of a nozzle having a fuel inlet portion 51 and a nozzle portion 52 and a throat 53. The jet pump 50 injects fuel from the nozzle portion 52 into the throat 53 to generate a vacuum pressure, thereby sucking fuel in the main fuel tank to the sub-tank 20. The fuel inlet portion 51 is integrated with the pump case 41 of the fuel pump 40 and projects toward the bottom of the main tank. The fuel inlet portion 51 and the nozzle portion 52 are connected by a fuel passage 511 so that a small portion of the fuel pressured by the fuel pump 40 can flow to the nozzle portion 52 and injected from a nozzle hole 521 of the nozzle portion 52 into the throat 53. The nozzle hole 521 opens toward the throat 53. The nozzle portion 52 is integrated with the pump case 41 to project from the bottom of the sub-tank toward the bottom of the main tank.

The throat 53 is also integrated with the bottom 20*a* of the sub-tank 20 so that the inlet portion of the throat 53 opens near the bottom of the main fuel tank and faces the nozzle portion 52. The throat 53 slightly inclines upward from the inlet portion thereof so that the outlet portion of the throat 53 opens in the sub-tank 20. A check valve 24 is fixed to the outlet portion of the throat 53 to prevent the fuel in the sub-tank 20 from returning to the main fuel tank. The check valve 24 can swing about a pin 241. If a fuel level is high, the check valve 24 is opened by the pressure of the fuel itself to introduce the fuel into the sub-tank 20. On the other hand, the check valve 24 opens to introduce the fuel into the sub-tank 20 only when the jet pump 50 injects fuel from the nozzle portion 52 into the throat 53.

The fuel inlet portion 51 and the nozzle portion 52 are integrated with the pump case 41 of fuel pump 40. The fuel filter 31 and fuel pump 40 are accommodated in the unit case 32 to form the pump unit 30. After the nozzle portion 52 is inserted into a through hole 23 shown in FIG. 2, the pump unit 30 is fixed to the support member 22 so that the sub-tank 20 and the pump unit 30 are assembled together. Thus, the nozzle portion 52 and the throat 53 of the jet pump 50 are disposed outside the sub-tank 20, so that the fuel passage between the fuel tank 20 and jet pump 50 can be made simple. Since the jet pump 50 is disposed near the bottom of the fuel tank, even a small amount of the fuel remaining in the fuel tank can be supplied to the engine.

When electric power is supplied to the fuel pump 40 through the electric connector 15, the fuel pump 40 sucks fuel in the sub-tank 20 through the suction filter 21 and discharges, the pressured fuel from the discharge pipe 14 via the fuel filter 31, the fuel pipe 33 and tubular bellows 16 to the engine.

At the same time, a portion of the fuel pressured by the fuel pump 40 is injected from the nozzle portion 52 via the fuel inlet portion 51 into the throat 53. When the fuel is injected, a vacuum pressure is generated, so that the fuel in the main tank flows into the sub-tank 20 through the throat 53 and the check valve 24 under the vacuum pressure.

Figure 2:
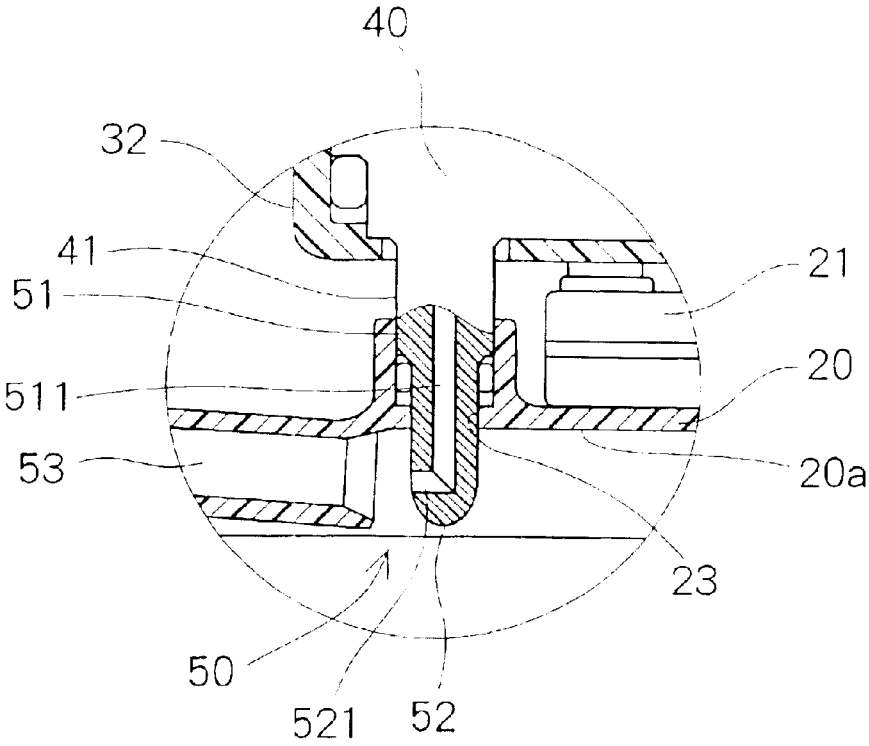
FIG. 2 is an enlarged schematic diagram illustrating a main portion of a jet pump of the fuel supplying apparatus shown in FIG. 1.
Figure 4:
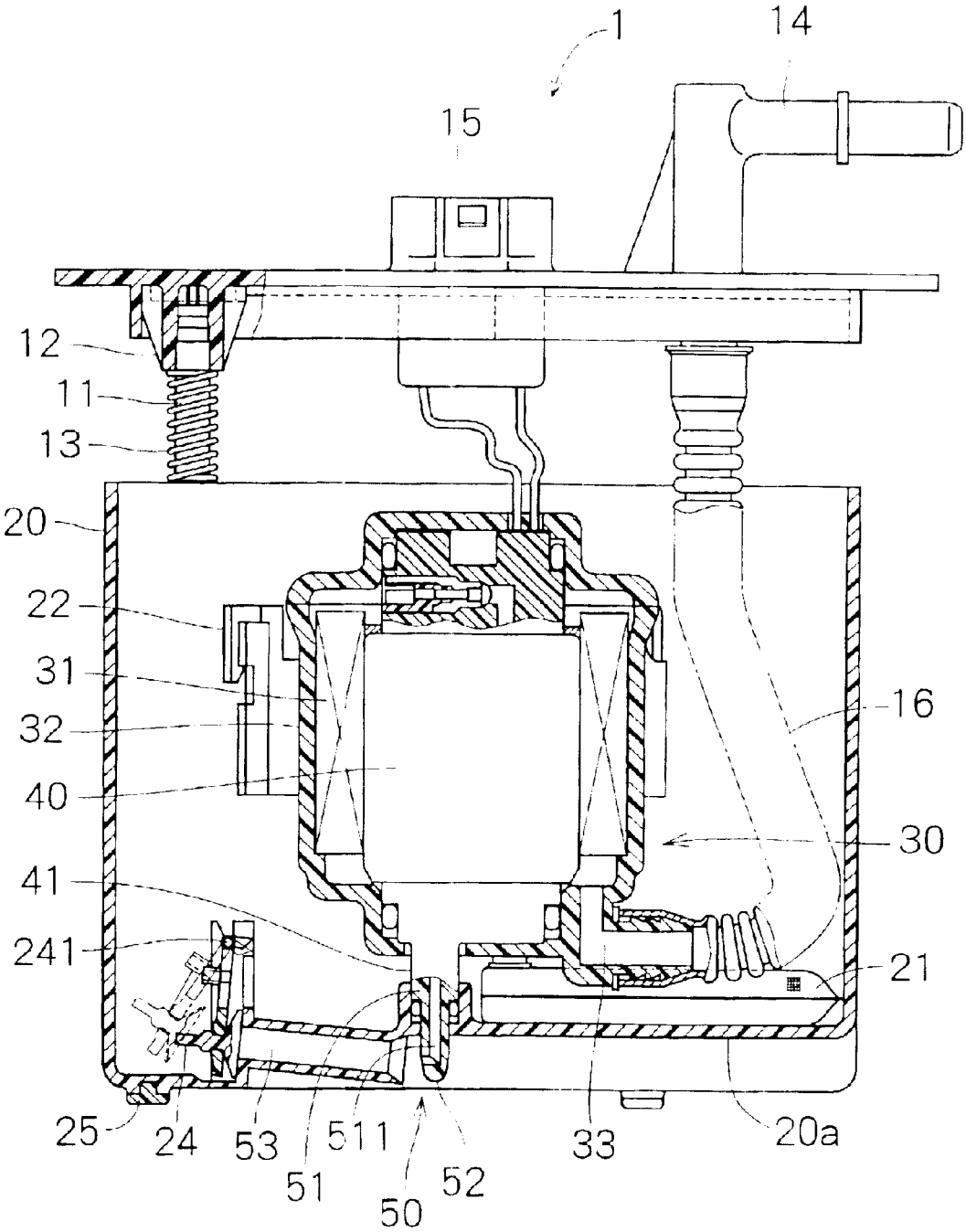
FIG. 4 is a schematic cross-sectional diagram illustrating a modified fuel supplying apparatus according to the preferred embodiment of the invention.

The sub-tank 20 of the fuel supplying apparatus has a step bottom wall so that a space for accommodating the nozzle and the throat can be formed between the sub-tank 20 and the bottom of the fuel tank, as shown in FIG. 1. However, the sub-tank 20 may have a plurality of cushion member 25 made of elastic material such as rubber on the bottom thereof, as shown in FIG. 4. The cushion member 25 is disposed between the bottom of the sub-tank 20 and the bottom of the main tank to provide a sufficient space for introducing fuel to the jet pump 50 and to moderate vibration transmitted from the main fuel tank to the sub-tank 20 and the fuel pump 40.

Figure 5:
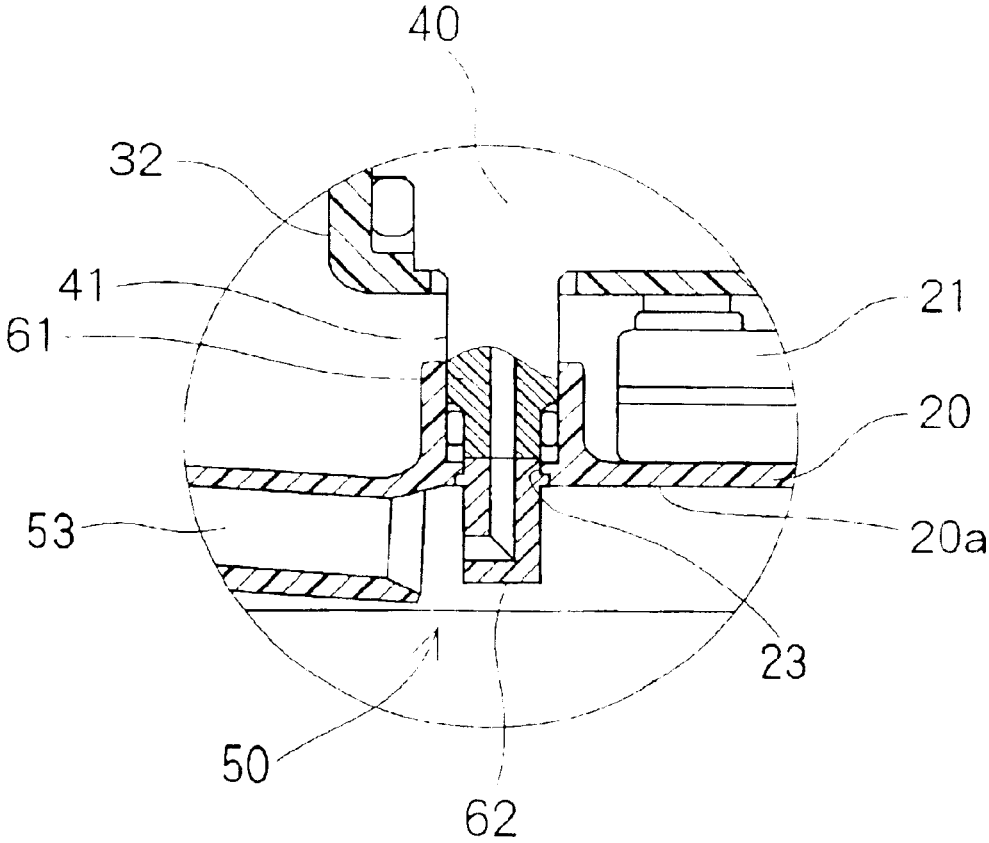
FIG. 5 is an enlarged schematic diagram illustrating a modified jet pump of the fuel supplying apparatus according to the preferred embodiment.

The nozzle of the jet pump 50 may be substituted by two separate members, fuel inlet member 61 and nozzle member 62, as shown in FIG. 5. The nozzle member 62 is inserted to the through hole 23. Therefore, it is easy to assemble the jet pump 50 into the sub-tank 20.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A fuel supplying apparatus for use with a main fuel tank and an engine comprising:

a fuel discharge pipe for supplying fuel to the engine;

a sub-tank having a bottom wall and disposed in the main fuel tank;

a fuel pump for pressurizing fuel, said fuel pump having a discharge port connected to said fuel discharge pipe and disposed in said sub-tank; and a jet pump including a throat having a fuel inlet opening disposed outside said sub-tank and a fuel discharge opening disposed inside said sub-tank and a nozzle having a fuel inlet portion connected to said discharge port of said fuel pump and a nozzle portion projecting from said sub-tank near said fuel inlet opening of said throat, thereby injecting pressured fuel into said inlet opening of said throat, wherein said fuel inlet portion of said nozzle is integrated with said fuel pump.

2. The fuel supplying apparatus as claimed in claim 1, wherein said fuel pump has a vent for venting gases generated inside said fuel pump.

3. The fuel supplying apparatus as claimed in claim 1, wherein said sub-tank and said throat are made of resinous material and integrated with each other.

4. The fuel supply apparatus as claimed in claim 1, wherein said nozzle comprises a separate nozzle member fixed to said sub-tank by fixing means.

5. The fuel supplying apparatus as claimed in claim 1, wherein said sub-tank has a cushion member between the bottom of said sub-tank and the bottom of the main tank.

6. The fuel supplying apparatus as claimed in claim 1, wherein said jet pump further comprises a check valve for preventing fuel in said sub-tank to said main tank at said fuel discharge-opening of said throat.

7. The fuel supplying apparatus as claimed in claim 1, wherein said fuel pump comprises a casing, and said fuel inlet portion is integrated with said casing.

8. The fuel supplying apparatus as claimed in claim 1, wherein said fuel inlet opening of said throat is disposed at said bottom wall of said sub-tank.

9. The fuel supplying apparatus as claimed in claim 4, wherein said sub-tank has a through hole to which said nozzle is inserted.

10. The fuel supplying apparatus as claimed in claim 8, wherein said sub-tank has a member at the bottom thereof for providing a space between said bottom wall of said sub-tank and the bottom of the main tank, and said fuel inlet opening is disposed in said space.

11. The fuel supplying apparatus as claimed in claim 1, wherein said sub-tank has a step bottom for accommodating said nozzle and said throat between said sub-tank and said main fuel tank.

12. A fuel supplying apparatus for use with a main fuel tank and an engine comprising:

a fuel discharge pipe for supplying fuel to the engine;

a sub-tank having a bottom wall and disposed in the main fuel tank;

a fuel pump for pressurizing fuel, said fuel pump having a discharge port connected to said fuel discharge pipe and disposed in said sub-tank; and a jet pump including a throat having a fuel inlet opening disposed outside said sub-tank and a fuel discharge opening disposed inside said sub-tank and a nozzle having a fuel inlet portion connected to said discharge port of said fuel pump and a nozzle portion projecting from said sub-tank near said fuel inlet opening of said throat, thereby injecting pressured fuel into said inlet opening of said throat, wherein said fuel pump includes a resinous case, and said nozzle is integrated with said resinous case.

* * * * *